US009756994B2

(12) United States Patent
Jackson

(10) Patent No.: US 9,756,994 B2
(45) Date of Patent: Sep. 12, 2017

(54) PORTABLE FOLDABLE TOILET SEAT OVERLAY APPARATUS

(71) Applicant: James Jackson, Atlanta, GA (US)

(72) Inventor: James Jackson, Atlanta, GA (US)

(73) Assignee: James Jackson

( * ) Notice: Subject to any disclaimer, the term of this patent is extended or adjusted under 35 U.S.C. 154(b) by 0 days.

(21) Appl. No.: 15/145,935

(22) Filed: May 4, 2016

(65) Prior Publication Data

US 2016/0242606 A1 Aug. 25, 2016

Related U.S. Application Data

(63) Continuation-in-part of application No. 14/587,934, filed on Dec. 31, 2014, now abandoned.

(51) Int. Cl.

| | |
|---|---|
| ***A47K 13/00*** | (2006.01) |
| ***A47K 13/06*** | (2006.01) |
| *A47K 13/02* | (2006.01) |
| *A47K 13/04* | (2006.01) |
| *A47K 13/12* | (2006.01) |

(52) U.S. Cl.
CPC ..... *A47K 13/005* (2013.01); *A47K 13/06* (2013.01); *A47K 13/02* (2013.01); *A47K 13/04* (2013.01); *A47K 13/12* (2013.01)

(58) Field of Classification Search
CPC ..... A47K 13/06
USPC ..... 4/237–241
See application file for complete search history.

(56) References Cited

U.S. PATENT DOCUMENTS

| | | | | | |
|---|---|---|---|---|---|
| 1,410,427 | A | * | 3/1922 | Turnquist | A47K 13/06 4/239 |
| 1,592,597 | A | * | 7/1926 | Becker | A47K 13/16 4/245.3 |
| 1,633,222 | A | * | 6/1927 | Noble | A47K 13/06 4/239 |
| 2,443,068 | A | * | 6/1948 | Dahle | A47K 13/06 4/239 |
| 2,454,199 | A | * | 11/1948 | Perrin | A47K 13/06 297/378.1 |
| 2,457,726 | A | * | 12/1948 | Harper | A47K 13/06 4/239 |
| 2,537,504 | A | * | 1/1951 | Anderson | A47K 13/06 150/107 |
| 2,682,914 | A | * | 7/1954 | Wing | A47K 13/06 4/239 |

(Continued)

*Primary Examiner* — Lori Baker
(74) *Attorney, Agent, or Firm* — Williams Intellectual Property; Benjamin F. Williams

(57) ABSTRACT

A portable foldable toilet seat overlay apparatus, foldable between a first position and a second position, deploys from a carry case to position atop an existing toilet set and prevent user contact therewith. The device includes a plurality of tractive members disposed perpendicularly projected from a bottom surface to frictionally engage with the toilet seat when the device is deployed in the first position. Each of the plurality of tractive members is arranged on the bottom surface so as to seat adjacently in contact with opposing portions of the bottom surface when the device is folded to the second position, without inhibiting movement of the device to the second position. In at least one embodiment the device is antimicrobial and, in another, biodegradable for single or limited use.

6 Claims, 5 Drawing Sheets

(56) References Cited

U.S. PATENT DOCUMENTS 3,261,030 A * 7/1966 Blem ..... A47K 13/02 4/239
4,525,880 A * 7/1985 Bass ..... A47K 13/14 297/221
D305,793 S * 1/1990 Cronk ..... A47K 13/14 D23/311
4,930,165 A * 6/1990 Wilson ..... A47K 13/00 16/225
D314,424 S * 2/1991 Davenport ..... A47K 13/14 D23/311
5,005,223 A * 4/1991 Greenwood ..... A47K 13/06 4/235
5,090,063 A * 2/1992 Edwards ..... A47K 13/14 206/225
D336,331 S * 6/1993 Arroyo ..... A47K 13/06 D23/311
5,267,355 A * 12/1993 Landman ..... A47K 13/02 4/237
5,542,131 A * 8/1996 Brantman ..... A47K 13/28 4/239
5,809,584 A * 9/1998 Potts ..... A47K 11/04 4/239
5,852,832 A * 12/1998 Voigt et al. ..... A47K 13/005 4/237
D410,533 S * 6/1999 Barlow ..... A47K 13/005 D23/311
6,068,118 A * 5/2000 Calloway ..... A47K 10/40 206/233
D434,479 S * 11/2000 Junk ..... A47K 10/40 D23/311
6,175,968 B1 * 1/2001 Schneider ..... A47K 13/005 4/239
D447,548 S * 9/2001 Schneider ..... A47K 13/005 D23/311
6,353,941 B1 * 3/2002 Manning ..... A47K 13/06 4/239
6,389,612 B1 * 5/2002 Harris ..... A47K 13/005 4/239
6,473,911 B2 * 11/2002 Weiss ..... A47K 13/06 4/239
D502,766 S * 3/2005 Nash ..... A47K 4/00 D23/311
6,889,393 B1 * 5/2005 Rinaldo ..... A47K 11/04 4/484
D529,152 S * 9/2006 Benjamin ..... A47K 11/04 D23/311
D559,368 S * 1/2008 Grant ..... A47K 11/04 D23/311
D594,537 S * 6/2009 Driedger ..... A47K 11/04 D23/311
7,631,370 B2 * 12/2009 Dunn ..... A47K 13/06 4/237
8,397,915 B2 * 3/2013 Davidson ..... A45C 11/00 119/161
8,677,518 B2 * 3/2014 Spievey ..... A47K 13/005 4/245.1
9,498,097 B2 * 11/2016 Shankar ..... A47K 13/06
2004/0210997 A1 * 10/2004 Samuels ..... A47K 4/00 4/484

* cited by examiner

PORTABLE FOLDABLE TOILET SEAT OVERLAY APPARATUS

CROSS-REFERENCE TO RELATED APPLICATIONS

This continuation in part application for utility patent claims the benefit of nonprovisional application Ser. No. 14/587,934 filed on Dec. 21, 2014.

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Sanitary conditions in public restrooms are often wanting, and in some instances and locations toilets may not even have seats. Use of such toilets is unappealing. As such, various types of portable toilet seats are known in the prior art devised to remove users from contact with said toilets.

Deployment of a lightweight apparatus which frictionally engages atop a toilet seat (or toilet bowl where seats are absent) to prevent user contact with the underlying toilet while enabling user comfort and maintaining sanitary conditions is therefore desirable. What is needed is a portable foldable toilet seat overlay apparatus that is foldable between a first position and a second position for portage and deployment whereby a user is enabled use of a toilet without actually contacting said toilet, and wherein sanitary portage of the device is enabled after use. The present portable foldable toilet seat overlay apparatus has been devised to enable sanitary portage by effectively folding a plurality of tractive members (devised to frictionally engage with the toilet seat when in use) interiorly disposed relative a top surface, and thereby prevent contact with other objects and prevent contamination a carry case devised for porting the device when disposed in the second position.

FIELD OF THE INVENTION

The present portable foldable toilet seat overlay apparatus, therefore, has been devised to resemble a toilet seat and fold from a first position to a second position for storage and portage. The present portable foldable toilet seat overlay apparatus includes a hinged ovoid perimetric member having a top surface and a bottom surface. A plurality of tractive members is disposed upon the bottom surface, each devised to frictionally engage a plurality of tractive pad members endwise disposed thereupon against an underlying toilet seat to which the apparatus is disposed. The portable foldable toilet seat overlay apparatus therefore positions overtop a toilet seat (or toilet bowl where a seat is absent) with only the plurality of tractive members in endwise contact therewith.

Movement of the ovoid perimetric member to the second position effectively folds said ovoid perimetric member in half, to position each of the plurality of tractive members endwise engaged against opposing portions of the bottom surface. Each of the plurality of tractive members is thus positioned appropriately relative one another so as not to inhibit movement of the ovoid perimetric overlay apparatus to the second position, and thereby to effectively seat in contact with the bottom surface only, whereby contact of each tractive member with anything other than the bottom surface of the ovoid tractive member is preventable.

In an embodiment of the invention contemplated herein, the ovoid perimetric member is formed of a lightweight polymer. In another embodiment contemplated herein, the ovoid perimetric member is biodegradable and adapted for single, or limited, use. In another embodiment the ovoid perimetric member includes antimicrobial elements to inhibit contamination during use.

SUMMARY OF THE INVENTION

The present portable foldable toilet seat overlay apparatus has been devised to enable expedient deployment from inside a carry case to position frictionally engaged atop an existing toilet seat whereby a user may sit upon said portable foldable toilet seat overlay apparatus without making contact with the existing toilet. Additionally, the device enables use of a toilet by smaller users, such as young children, whereby an existing toilet (which may otherwise by to large for a child) is adapted to a size more appropriate for use by said children.

The present portable foldable toilet seat is contemplated to be lightweight, molded of polymer in an example embodiment, and biodegradable for single or limited use in another embodiment. Antimicrobial agents may be used upon surfaces of the device, or throughout the device proper, to inhibit proliferation of microbes and limit user exposure to pathogens while folding the device for storage or portage previous to cleaning or between uses, as will be described subsequently.

The present portable foldable toilet seat overlay apparatus, therefore, is storable interior to a carry case for portage, as desired. The present potable foldable toilet seat overlay apparatus is foldable between a first position and a second position, whereby a plurality of tractive members is revealable for engagement atop an existing toilet seat to stably position the present device for use upon a toilet. In the preferred embodiment herein presented, the portable foldable toilet seat overlay apparatus is formed of lightweight, biodegradable polymer, and includes antimicrobial elements whereby pathogens are inhibited upon contact with at least portions of the present device.

The present portable foldable toilet seat overlay apparatus, therefore, includes an ovoid perimetric member devised to encircle atop an existing toilet seat. The ovoid perimetric member bounds a central aperture positionable centrally over the toilet bowl when the apparatus is positioned appropriately upon an existing toilet seat. The ovoid perimetric member includes an anterior apex disposed to face forwards atop a toilet seat, and a posterior end configured to fit rearwards atop said seat. The posterior end may be straight-edged, to accommodate a rearward cistern. A first side borders one half of the ovoid perimetric member and a second side borders the other half of the ovoid perimetric member. A bowed top surface is disposed to be up-facing from the toilet seat upon which the device is positioned. The top surface may resemble a toilet seat in general appearance. A bottom surface is disposed to be down-facing atop the toilet seat.

A first hinge member is disposed underlying the anterior apex and a second hinge member is disposed underlying the posterior side, said second hinge member disposed along a congruent axis as the first hinge member. The ovoid perimetric member, therefore, folds each of the first side and the second side together along a central longitudinal axis, to position the bottom surface of each of said first side and second sides in parallel relation, and yet maintain position of the top surface as a flush continuous surface, with each of the first and second sides disposed adjacently in a common plane, when moved to the first position.

A plurality of tractive members is disposed perpendicularly projected from the bottom surface to contact the existing toilet seat upon which the device is placed, and thereby maintain the bottom surface spaced apart from, and parallel with, the toilet seat during use. When correctly deployed, only the tractive members will contact the toilet seat with which the device is used.

To prevent slippage during use, and increase stability of the present device—especially when a user moves to sit upon, or stand up from, the device—a plurality of tractive pad members is disposed endwise atop each of the plurality of tractive members. Each of the plurality of tractive pad members is devised of a polymeric or rubberlike substance with a high coefficient of friction.

Each of the plurality of tractive members further includes a body member and a sloped surface terminating the body member at a farthermost extreme relative the bottom surface of the ovoid perimetric member. These sloped surfaces slope towards the center of the toilet atop which the ovoid perimetric member is positioned, and thereby present a center of gravity towards the center of the toilet. Each of the tractive pad members is disposed atop the sloped surface to frictionally engage in contact with the underlying toilet seat. Each of the tractive pad members may be compressible to further engage against the toilet seat when a person sits upon the ovoid perimetric member.

When not in use, the ovoid perimetric member is foldable between a first position, wherein the first side and second side are coplanar and adjacently disposed, and a second position, wherein the first and second sides fold to position the bottom surface together whereby said first and second sides are disposed in parallel and adjacent planes. Each of the tractive members is staggered appropriately upon the bottom surface whereby each tractive member seats into contact with the bottom surface of the opposing side of said ovoid perimetric member without effecting endwise contact with any other tractive member.

Thus the ovoid perimetric member folds to position each of the tractive members interiorly when said ovoid perimetric member is moved to the second position, and the top surface is thereby positioned exteriorly outfacing. Contact of the tractive members with the carry case, or contact with anything other than appropriate areas of the bottom surface of the ovoid perimetric member, is avoidable when said ovoid perimetric member is disposed in the second position. The present device thereby enables sanitary portage.

A second ovoid perimetric member is contemplated as part of the invention. The second ovoid perimetric member is substantially similar to the ovoid perimetric member previously described, and enabled below, however the second ovoid perimetric member is devised to seat concentrically atop the ovoid perimetric member whereby the second ovoid perimetric member is usable by smaller children, for example. The second parametric member is thus similarly deployable, but is configured to rest atop the ovoid perimetric member to encircle a smaller central aperture. The second ovoid perimetric member may therefore by desirable for use when potty training children in the home, for example, or when taking children to a public restroom where unsanitary conditions prevail and toilet seats are potentially contaminated. The second ovoid perimetric member is likewise contemplated to be storable interior to the carry case for ready portage and expedient deployment, as desired.

Thus has been broadly outlined the more important features of the present portable foldable toilet seat overlay apparatus so that the detailed description thereof that follows may be better understood and in order that the present contribution to the art may be better appreciated.

Objects of the present portable foldable toilet seat overlay apparatus, along with various novel features that characterize the invention are particularly pointed out in the claims forming a part of this disclosure. For better understanding of the portable foldable toilet seat overlay apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
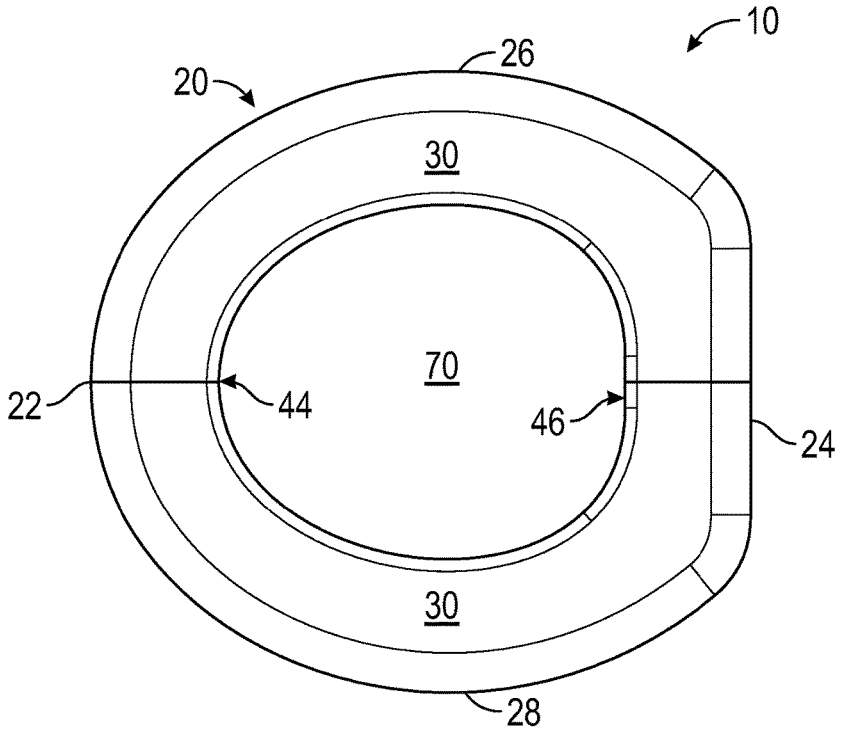
FIG. 1 is a top view of an example embodiment.
Figure 2:
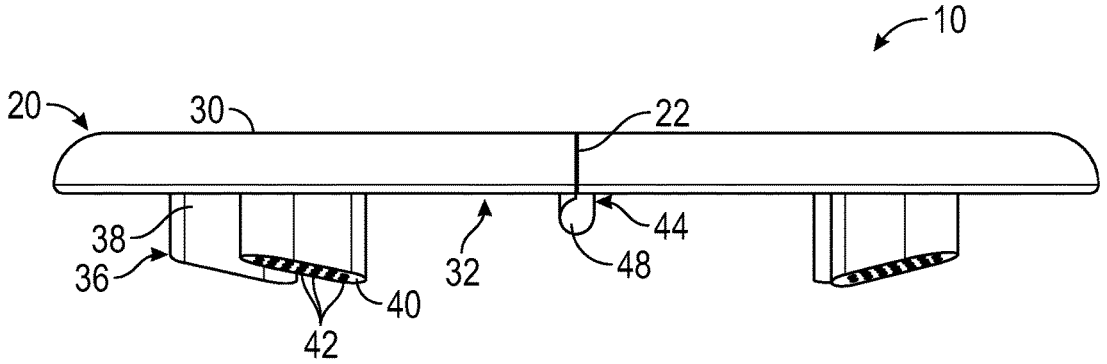
FIG. 2 is a front view of an example embodiment.
Figure 3:
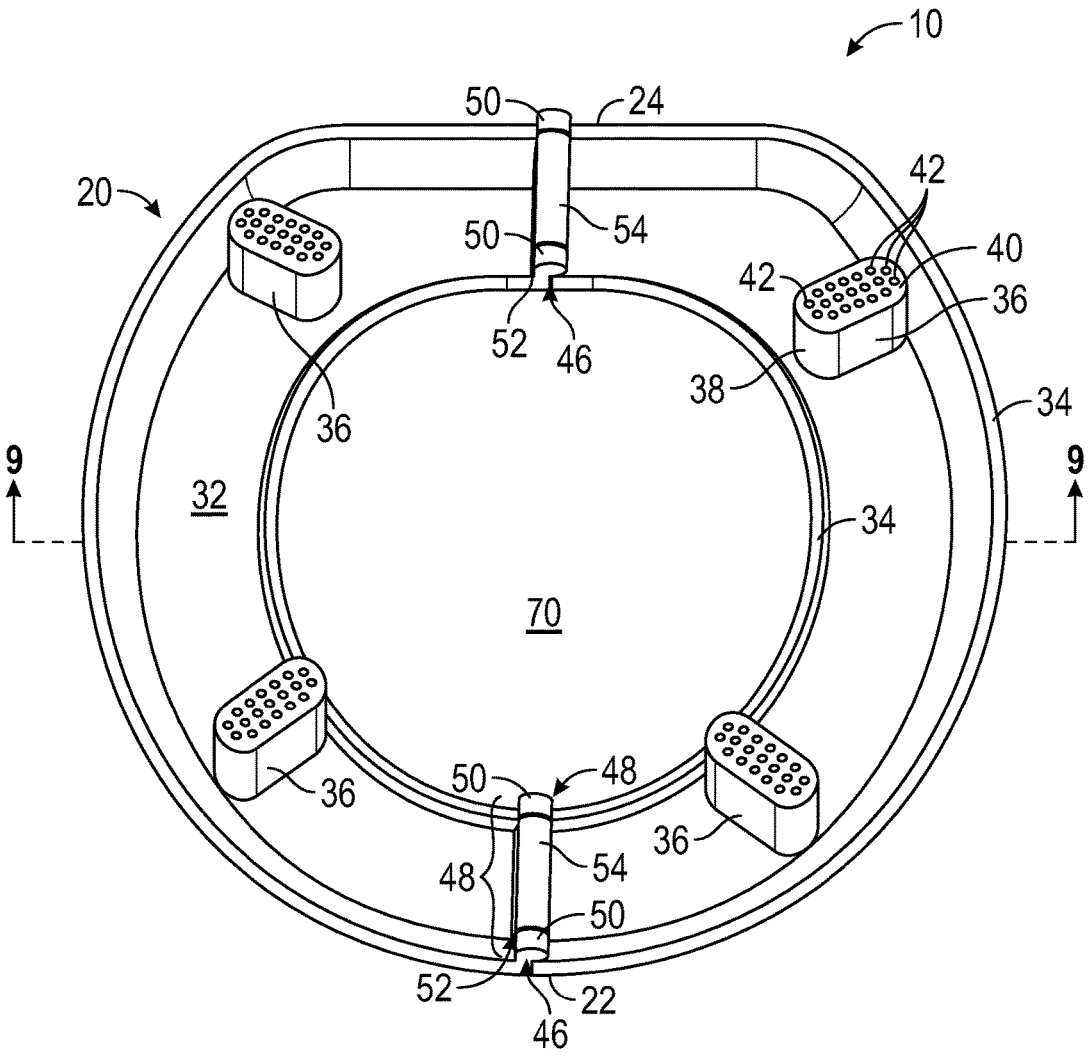
FIG. 3 is a bottom view of an example embodiment.
Figure 4:
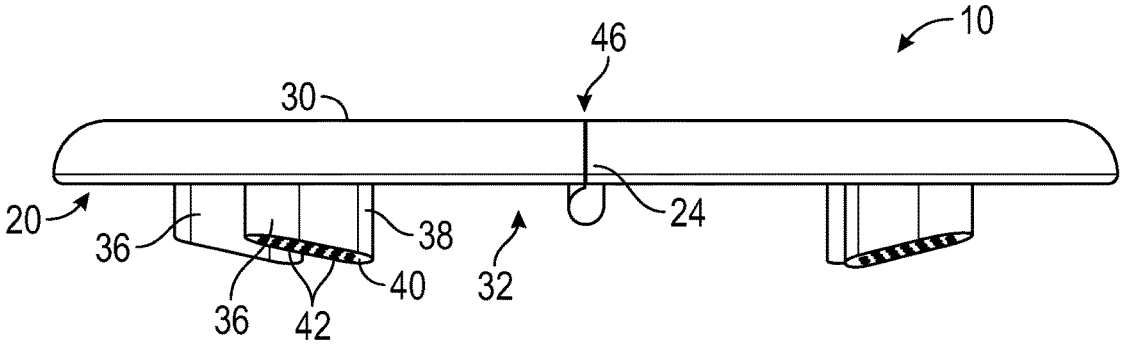
FIG. 4 is a read view of an example embodiment.

With reference now to the drawings, and in particular FIGS. 1 through 9 thereof, example of the instant portable foldable toilet seat overlay apparatus employing the principles and concepts of the present portable foldable toilet seat overlay apparatus and generally designated by the reference number 10 will be described.

Referring to FIGS. 1 through 9 a preferred embodiment of the present portable foldable toilet seat overlay apparatus 10 is illustrated.

The present portable foldable toilet seat overlay apparatus 10 has been devised for portage and expedient use in public restrooms to prevent user contact with an existing toilet seat 100. The present portable foldable toilet seat overlay apparatus 10 readily deploys from storage interior to a carry case 56 into a first position to frictionally engage atop an existing toilet seat 100 and resist displacement during use, whereby a user may sit atop the present portable foldable toilet seat overlay apparatus 10 without fear of contacting the underlying toilet seat 100 atop which the present device 10 is frictionally engaged (see for example FIG. 8).

The present portable foldable toilet seat overlay apparatus 10, therefore, includes an ovoid perimetric member 20 disposed circumferentially bounding a central aperture 70. The ovoid perimetric member 20 is devised to resemble a toilet seat. The ovoid perimetric member 20 therefore includes an anterior apex 22 disposed anteriorly delimiting the ovoid perimetric member 20, a posterior end 24 disposed posteriorly delimiting the ovoid perimetric member 20, a first side 26 bounding one half of the central aperture 70, and a second side 28 bounding the other half of the central aperture 70. A top surface 30 is disposed for contact by a user and a bottom surface 32 is disposed for parallel positioning overtop an existing toilet seat 100 to which the present device 10 is deployed.

Figure 9:
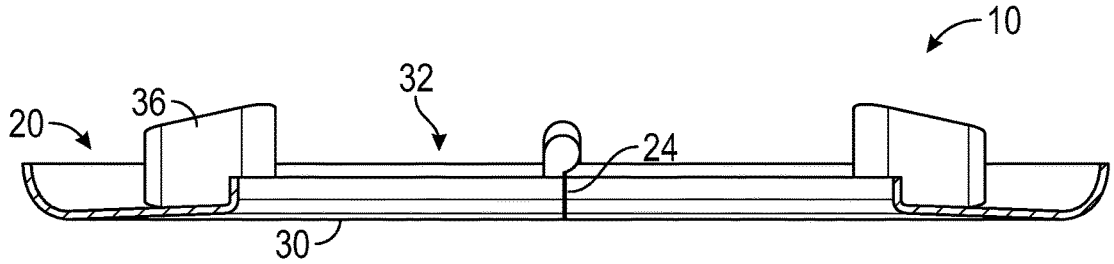
FIG. 9 is a transverse cross-section view of an example embodiment taken along the line A-A of FIG. 3.

The ovoid perimetric member 20 has an arced transverse cross-section 80 disposed to transversely bow the top surface 30 between each of a pair of concentric lowermost rims 34 (see FIG. 9). The top surface 30 is thus adapted for sitting thereupon while enabling drainage of any fluid off said top surface 30 toward each of the pair of lowermost rims 34. The pair of concentric lowermost rims 34 further deploy together to enclose the bottom surface 32 when the ovoid perimetric member 20 is moved to the second position and thereby contain a plurality of tractive members 36 therein, as will be described subsequently.

The plurality of tractive members 36 is perpendicularly disposed upon the bottom surface 32 of the ovoid perimetric member 20. Each of the plurality of tractive members 36 includes a body member 38 disposed perpendicularly projected from the bottom surface 32. A sloped surface 40 is disposed terminating said body member 38, said sloped surface 40 angled downwards towards the central aperture 70. A plurality of antimicrobial tractive pad members 42 is disposed atop the sloped surface 40, each of said tractive pad members 42 comprising a rubberlike material effective for frictional engagement in contact with an underlying surface atop which the apparatus 10 is disposed. Each of the plurality of tractive pad members 42 may include an antimicrobial agent to inhibit pathogens and contaminants during use. Thus, once deployed atop a toilet seat 100 for use, the device 10 resists displacement during use, including when a user moves to sit or stand relative the device 10, and prevents contamination by inhibiting coliform bacteria.

To enable movement of the device 10 between the first and second positions, a molded first hinge member 44 is disposed longitudinally at the anterior apex 22 joining the first side 26 and the second side 28 of the ovoid perimetric member 20 and a molded second hinge member 46 is disposed longitudinally at the posterior end 24 joining the first side 26 and the second side 28 of the ovoid parametric member 20. The second hinge member 46 is disposed along a congruent axis relative the first hinge member 44. Each of said first and second hinge members 44, 46 includes a stirrup member 48 having a pair of ends 50 projected perpendicularly from a base member 52 and a cylindrical member 54 therein rotatably endwise engaged, as will be described subsequently.

The stirrup member 48 and cylindrical member 54 are positioned on the underside of the ovoid perimetric member 20, whereby the top surface 30 of said ovoid perimetric member 20 is a generally suffuse, bowed surface, absent protuberances, whereby comfort during use is unimpeded.

The stirrup member 48 is disposed upon the second side 28 of the ovoid perimetric member 20 to endwise engage with the cylindrical member 54 disposed upon the first side 26 of the ovoid perimetric member 20. The cylindrical member 54 is enabled rotation seated into the stirrup member 48, whereby movement of the first and second sides 26, 28 relative each other enables deployment of the ovoid perimetric member 20 between the first and second positions. It should be noted that each of the pair of ends 50 of the stirrup member 48 is projected from the bottom surface 32 to a lesser extremity relative the position of the sloped surface 40 of each of the plurality of tractive members 36, whereby the first and second hinge members 44, 46 do not contact the underlying toilet seat 100 to which the present device 10 is deployed.

A carry case 56 is included devised to accommodate the ovoid perimetric member 20 when disposed in the second position. The ovoid perimetric member 20 is thereby foldable into the second position and stowable interior to the carry case 56 for portage. It should be noted that each of the plurality of tractive members 36 is positioned staggered appropriately upon the bottom surface 32 to seat adjacently, and therefore not impede movement of the ovoid perimetric member 20, when the ovoid perimetric member 20 is moved to the second position. The ovoid perimetric member 20 therefore folds to position the bottom surface 32 in facing opposition, whereby each of the plurality of tractive members 36 is caused to conjunct the bottom surface 32 without contacting each other, and each of said first and second sides 26, 28 positions into adjacent parallel planes. Thus deployment of the ovoid tractive member 20 into the second position for portage interior to the carry case prevents the tractive members 36 from contacting the carry case 56 during portage therein (see for example FIG. 6).

Figure 5:
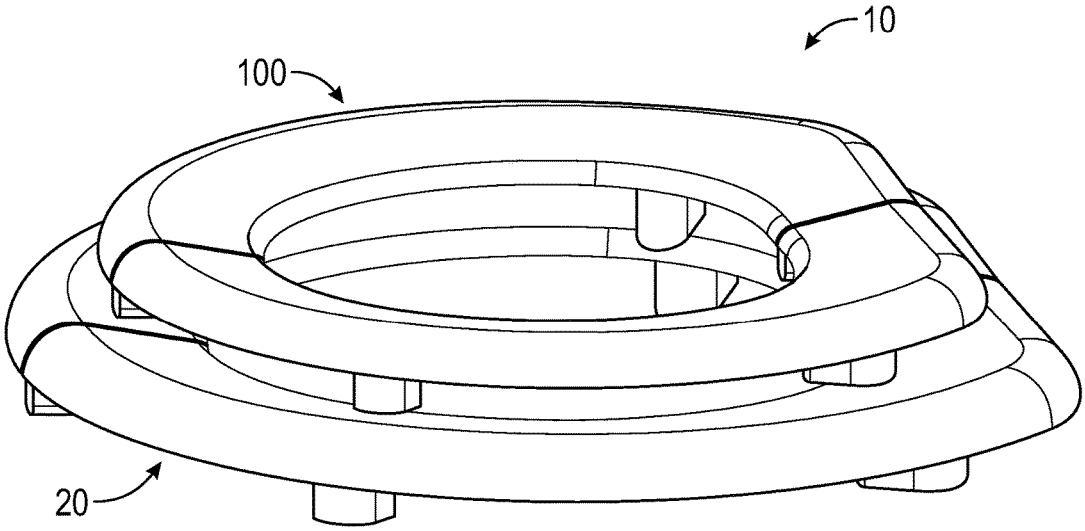
FIG. 5 is an elevation view of an example embodiment illustrating a second ovoid perimetric member deployed atop an ovoid perimetric member, said second ovoid perimetric member sized to position an open center concentrically thereover.
Figure 6:
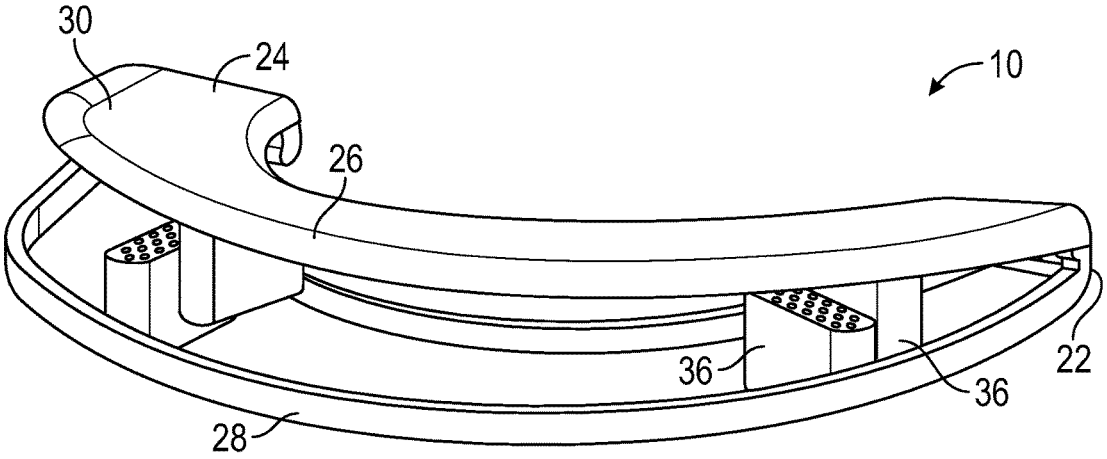
FIG. 6 is an elevation view of an example embodiment disposed folded into a second position.
Figure 7:
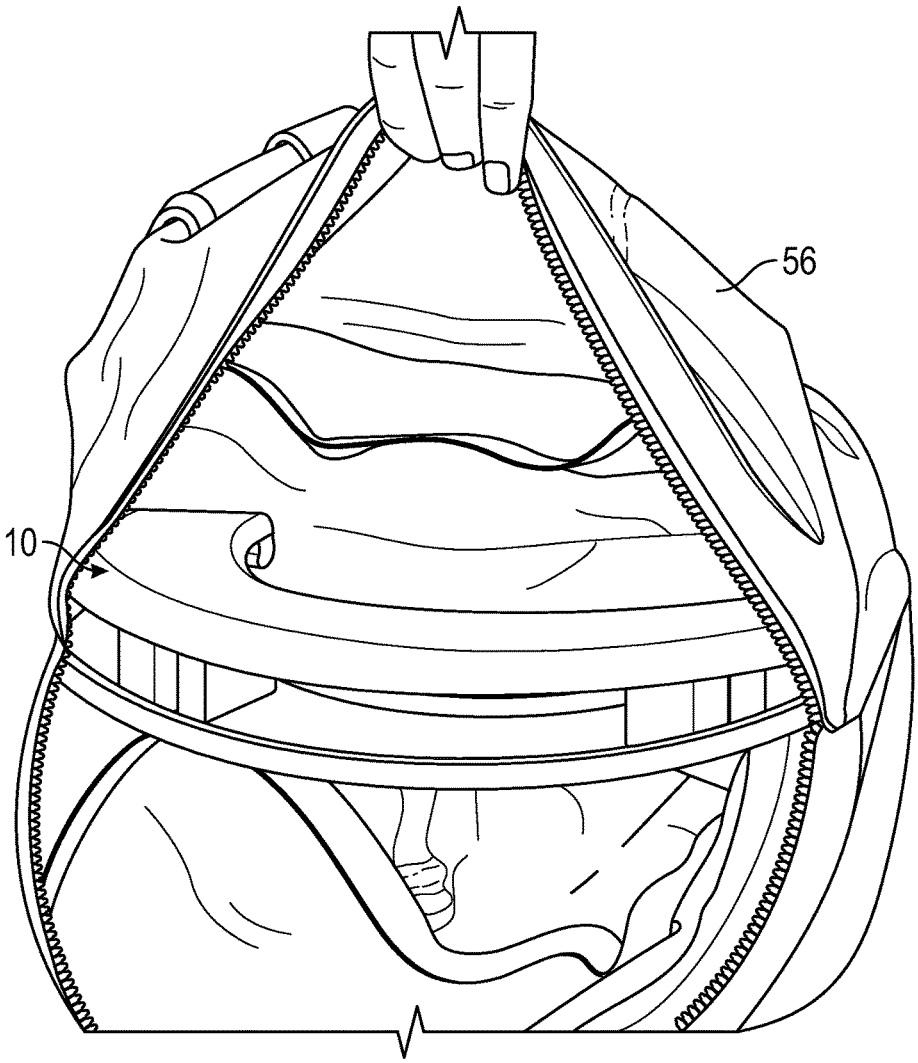
FIG. 7 is an elevation view of an example embodiment fit interior to a carry case.
Figure 8:
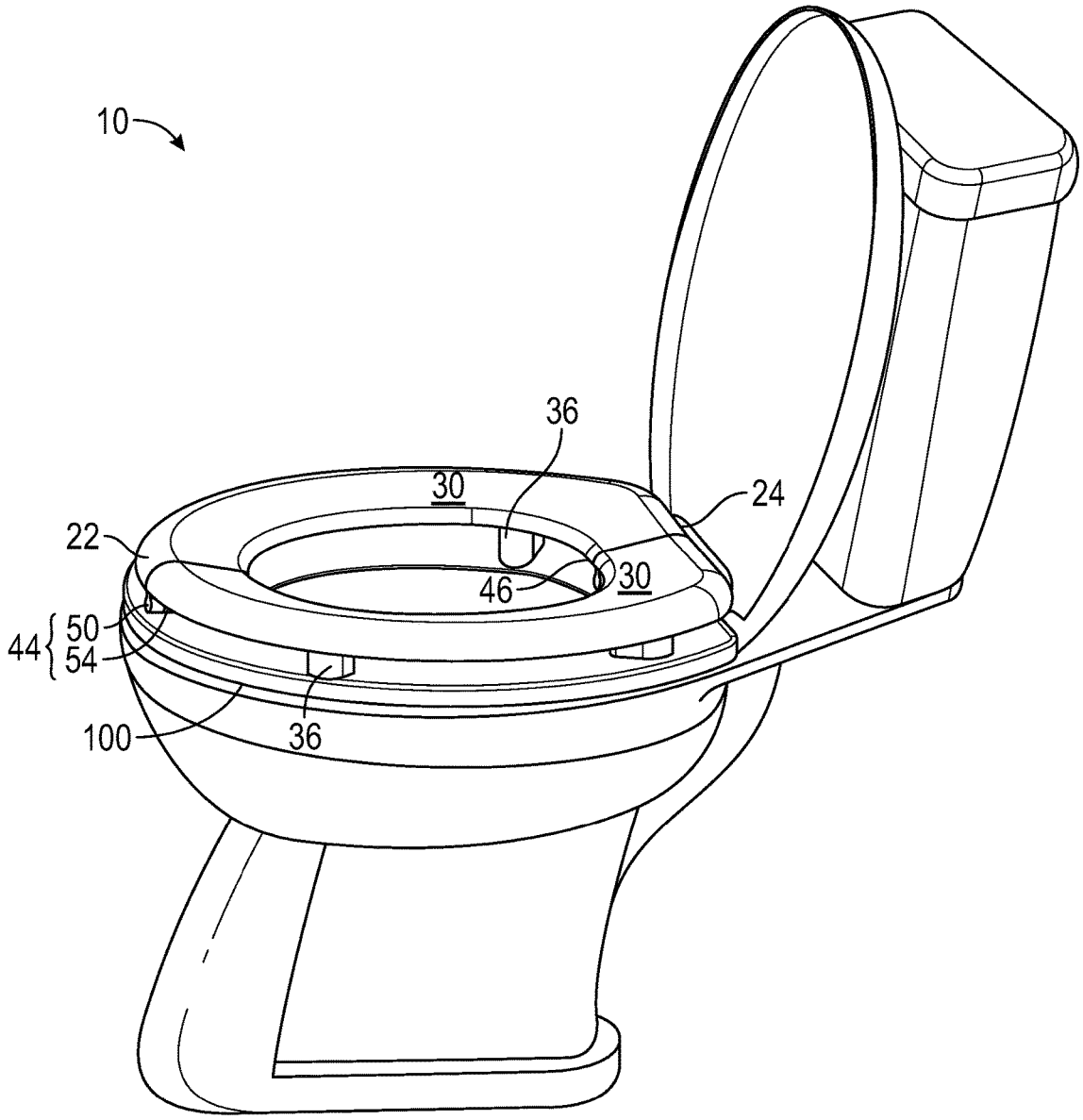
FIG. 8 is an elevated view of an example embodiment disposed atop an existing toilet seat of an existing toilet.

The portable foldable toilet seat overlay apparatus 10 also may include a second ovoid perimetric member 60 sized to fit atop the portable foldable toilet seat overlay apparatus 10 for use by a smaller user (see FIG. 5). The second ovoid perimetric to member 60 may also fittable interior to the carry case 56.

What is claimed is:

1. A portable foldable toilet seat overlay apparatus comprising an ovoid perimetric member disposed circumferentially bounding a central aperture, said ovoid perimetric member positionable between a first position and a second position, said ovoid perimetric member comprising:

a first side;

a second side hingedly connected to the first side, said second side foldable to conjunct underneath the first side when moved to the second position;

an anterior apex anteriorly terminating the perimetric member;

a posterior side posteriorly terminating the perimetric member;

a top surface atop the ovoid perimetric member;

a bottom surface underlying the ovoid perimetric member;

a plurality of tractive members disposed perpendicularly projected from the bottom surface, each of said plurality of tractive members comprising:

a body member disposed perpendicularly projected from the bottom surface;

a sloped surface disposed terminating said body member, said sloped surface angled downwards towards the central aperture;

a plurality of tractive pad members disposed atop the sloped surface, each of said tractive pad members comprising a rubberlike material to effect frictional engagement in contact with an underlying surface atop which the apparatus is disposed;

a first hinge member disposed longitudinally at the anterior apex between the first side and the second side of the ovoid perimetric member;

a second hinge member disposed longitudinally at the posterior end between the first side and the second side of the ovoid perimetric member, said second hinge member disposed along a congruent axis relative the first hinge member, each of said first and second hinge member comprising:

a stirrup member members disposed upon the second side of the ovoid perimetric member, said stirrup member having a pair of ends endwise projected perpendicularly from a base member, each of said pair of ends projected from the bottom surface to a distance less than the distance of the sloped surface of each of the plurality of tractive members;

a cylindrical member disposed rotatably engaged by the stirrup member; said cylindrical member disposed upon the first side of the ovoid perimetric member, whereby movement between the first and second positions is enabled by rotational engagement of said cylindrical member within the pair of ends of the stirrup member;

an arced transverse cross-section of the ovoid perimetric member whereby the top surface of the ovoid perimetric member is transversely bowed between each of a pair of concentric lowermost rims;

and a carry case disposed to accommodate the ovoid perimetric member when disposed in the second position;

wherein the ovoid perimetric member is moveable into the first position with each of the first and second sides disposed approximal and coplanar for use atop an existing toilet seat, said ovoid perimetric member moveable to the second position with each of the first side and second side folded together in parallel planes for portage and storage interior to the carry case, whereby the plurality of tractive members conjunct the bottom surface when the said first and second sides are folded together in the second position and the plurality of tractive pad members are thereby prevented from contacting the carry case during portage, whereby a user may deploy the portable foldable toilet seat overlay apparatus to prevent user contact with an existing toilet seat and maintain the plurality of tractive pad members from contacting the carry case.

2. The portable foldable toilet seat overlay apparatus of claim 1 wherein the tractive pad members are antimicrobial.

3. The portable foldable toilet seat overlay apparatus of claim 1 further comprising a second ovoid perimetric member sized to fit atop the portable foldable toilet seat overlay apparatus for use by a smaller user.

4. The portable foldable toilet seat overlay apparatus of claim 1 wherein the ovoid perimetric member is biodegradable and adapted for single or limited use.

5. A portable foldable toilet seat overlay apparatus foldable between a first position and a second position, said portable foldable toilet seat overlay apparatus comprising:

an ovoid perimetric member disposed circumferentially bounding a central aperture, said ovoid perimetric member comprising:

an anterior apex disposed anteriorly delimiting the ovoid perimetric member;

a straight-edged posterior end disposed posteriorly delimiting the ovoid perimetric member;

a first side bounding one half of the central aperture;

a second side bounding the other half of the central aperture;

a top surface;

a bottom surface;

an arced transverse cross-section, said arced transverse cross-section disposed to transversely bow the top surface between each of a pair of concentric lowermost rims;

a polymeric molded first hinge member disposed longitudinally at the anterior apex between the first side and the second side of the ovoid perimetric member;

a polymeric molded second hinge member disposed longitudinally at the posterior end between the first side and the second side of the ovoid parametric member, said second hinge member disposed along a congruent axis relative the first hinge member, each of said first and second hinge member comprising:

a stirrup member disposed upon the second side of the ovoid perimetric member, said stirrup member having a pair of ends projected perpendicularly from a base member, each of said pair of ends projected from the bottom surface to a distance less than the distance of the sloped surface of each of the plurality of tractive members;

a cylindrical member disposed rotatably engaged by the pair of ends of the stirrup member, said cylindrical seat member disposed upon the first side of the ovoid perimetric member;

a plurality of tractive members disposed upon the bottom surface of the ovoid perimetric member, each of said plurality of tractive members comprising:

a body member disposed perpendicularly projected from the bottom surface;

a sloped surface disposed terminating said body member, said sloped surface angled downwards towards the central aperture;

a plurality of antimicrobial tractive pad members disposed atop the sloped surface, each of said tractive pad members comprising a rubberlike material to effect frictional engagement in contact with an underlying surface atop which the apparatus is disposed; and a carry case disposed to accommodate the ovoid perimetric member when disposed in the second position;

wherein the ovoid perimetric member is hingedly foldable between the first position, with each of said first and second sides disposed coplanar and adjacently disposed, and the second position, with each of the plurality of tractive members enclosed conjunct the bottom surface and each of said first and second sides disposed in parallel planes, whereby the portable foldable toilet seat overlay apparatus is deployable for tractive engagement atop an existing toilet and thereby preventative of a user having to contact said existing toilet, and said portable foldable toilet seat overlay apparatus is stowable interior to the carry case without the tractive members contacting the carry case during portage therein.

6. The portable foldable toilet seat overlay apparatus of claim 5 further comprising a second ovoid perimetric member sized to fit atop the portable foldable toilet seat overlay apparatus for use by a smaller user, said second ovoid perimetric member also fittable interior to the carry case.

* * * * *